US007924241B2

(12) United States Patent
Cho et al.

(10) Patent No.: US 7,924,241 B2
(45) **Date of Patent: *Apr. 12, 2011**

(54) PLASMA DISPLAY APPARATUS AND METHOD OF DRIVING THE SAME

(75) Inventors: Janghwan Cho, Seoul (KR); Hyunil Park, Seongnam-si (KR); Changjoon Park, Seoul (KR); Sunghwan Kim, Seoul (KR)

(73) Assignee: LG Electronics Inc., Seoul (KR)

( * ) Notice: Subject to any disclaimer, the term of this patent is extended or adjusted under 35 U.S.C. 154(b) by 907 days.

This patent is subject to a terminal disclaimer.

(21) Appl. No.: 11/840,856

(22) Filed: Aug. 17, 2007

(65) Prior Publication Data

US 2008/0042934 A1 Feb. 21, 2008

(30) Foreign Application Priority Data

Aug. 18, 2006 (KR) ..... 10-2006-0078119

(51) Int. Cl.
*G09G 3/28* (2006.01)

(52) U.S. Cl. ..... 345/63; 345/60

(58) Field of Classification Search ..... 345/60–70; 315/169.1–169.4

See application file for complete search history.

(56) References Cited

U.S. PATENT DOCUMENTS

| | | | | |
|---|---|---|---|---|
| 5,566,064 | A * | 10/1996 | Schoenwald et al. | 363/132 |
| 5,874,828 | A * | 2/1999 | Lee | 323/274 |
| 6,680,717 | B2 * | 1/2004 | Tanaka | 345/60 |
| 2006/0250329 | A1 * | 11/2006 | Choi | 345/60 |
| 2008/0055302 | A1 * | 3/2008 | Cho et al. | 345/214 |

FOREIGN PATENT DOCUMENTS

| | | | |
|---|---|---|---|
| KR | 10-2005-0100943 | A | 10/2005 |
| KR | 10-2005-0112851 | A | 12/2005 |
| KR | 10-2006-0040050 | A | 5/2006 |
| KR | 10-0599660 | B1 | 7/2006 |

* cited by examiner

*Primary Examiner* — Ricardo L Osorio
(74) *Attorney, Agent, or Firm* — Birch, Stewart, Kolasch & Birch, LLP

(57) ABSTRACT

A plasma display apparatus and a method of driving the same are disclosed. The plasma display apparatus includes a plasma display panel including first, second and third electrodes, a sustain driver supplying a sustain signal to the first electrode during a sustain period, a data driver supplying a data signal to the third electrode during an address period, a first reference voltage source that is commonly connected to the sustain driver and the second electrode, a second reference voltage source connected to the data driver, and a reference separation controller. The reference separation controller separates or connects the first reference voltage source from or to the second reference voltage source.

14 Claims, 13 Drawing Sheets

PLASMA DISPLAY APPARATUS AND METHOD OF DRIVING THE SAME

This application claims the benefit of Korean Patent Application No. 10-2006-0078119 filed on Aug. 18, 2006, which is hereby incorporated by reference.

BACKGROUND OF THE DISCLOSURE

1. Field of the Disclosure

This document relates to a plasma display apparatus and a method of driving the same.

2. Description of the Background Art

A plasma display apparatus generally includes a plasma display panel displaying an image, and a driver attached to the rear of the plasma display panel to drive the plasma display panel.

The plasma display panel has the structure in which barrier ribs formed between a front substrate and a rear substrate form unit discharge cell or discharge cells. Each discharge cell is filled with an inert gas containing a main discharge gas such as neon (Ne), helium (He) or a mixture of Ne and He, and a small amount of xenon (Xe). The plurality of discharge cells form one pixel. For instance, a red (R) discharge cell, a green (G) discharge cell, and a blue (B) discharge cell form one pixel.

When the plasma display panel is discharged by a high frequency voltage, the inert gas generates vacuum ultraviolet rays, which thereby cause phosphors formed between the barrier ribs to emit light, thus displaying an image. Since the plasma display panel can be manufactured to be thin and light, it has attracted attention as a next generation display device.

The study of an increase in life span of the plasma display apparatus has continued.

SUMMARY OF THE DISCLOSURE

This document provides a plasma display apparatus including a reference separation controller between a reference voltage source connected to a sustain driver supplying a sustain signal to a scan electrode and a sustain electrode and a reference voltage source connected to a data driver supplying a data voltage to an address electrode.

This document also provides a method of driving a plasma display apparatus capable of separating a reference voltage source connected to a sustain driver from a reference voltage source connected to a data driver during a sustain period when the plasma display apparatus is driven.

This document also provides a method of driving a plasma display apparatus capable of preventing a damage to a phosphor caused by an opposite discharge by supplying a data voltage to a data electrode or floating the data electrode during a sustain period.

In one aspect, a plasma display apparatus comprises a plasma display panel including a first electrode, a second electrode, and a third electrode positioned in an intersection direction of the first electrode and the second electrode, a sustain driver that supplies a sustain signal including a positive sustain voltage and a negative sustain voltage to the first electrode during a sustain period, a data driver that supplies a data signal to the third electrode during an address period, a first reference voltage source that is commonly connected to the sustain driver and the second electrode, a second reference voltage source connected to the data driver, and a reference separation controller that separates or connects the first reference voltage source from or to the second reference voltage source.

The reference separation controller may be turned on during a positive sustain voltage maintenance period when a voltage level of the first electrode is maintained at the positive sustain voltage, so that the first reference voltage source is connected to the second reference voltage source. The reference separation controller may be turned off during the remaining period of time except the positive sustain voltage maintenance period from the sustain period, so that the first reference voltage source is separated from the second reference voltage source.

The data driver may include a top switch that controls the supply of a data voltage output from a data constant voltage source to the third electrode, and a bottom switch that controls the supply of a second reference voltage output from the second reference voltage source to the third electrode.

The top switch and the bottom switch may be turned off during a period of time when the sustain driver supplies the sustain signal to the first electrode so that the data driver is in a hi-impedance state.

The third electrode may be clamped during the positive sustain voltage maintenance period, so that a voltage level of the third electrode is maintained at the data voltage. The third electrode may be floated during the remaining period of time except the positive sustain voltage maintenance period from the sustain period.

A floating voltage of the third electrode may be substantially equal to a sum of the data voltage and the negative sustain voltage during a period of time when the negative sustain voltage is supplied to the first electrode.

The top switch may be controlled to supply the data voltage to the third electrode during a first period of the positive sustain voltage maintenance period, the first period being shorter than the positive sustain voltage maintenance period. The bottom switch may be controlled to supply the second reference voltage to the third electrode during a second period of the positive sustain voltage maintenance period which follows the first period. The third electrode may be floated during the remaining period of time except the positive sustain voltage maintenance period from the sustain period.

In another aspect, a plasma display apparatus comprises a plasma display panel including a first electrode, a second electrode, and a third electrode positioned in an intersection direction of the first electrode and the second electrode, a sustain driver whose one terminal is connected to the first electrode, and the other terminal is commonly connected to the second electrode and a first reference voltage source, a reference separation switch whose one terminal is commonly connected to the other terminal of the sustain driver, the first reference voltage source, and the second electrode, and the other terminal is connected to a second reference voltage source, a top switch whose one terminal is connected to the third electrode, and the other terminal is connected to a data constant voltage source, and a bottom switch whose one terminal is commonly connected to the third electrode and one terminal of the top switch, and the other terminal is commonly connected to the second reference voltage source and the other terminal of the reference separation switch.

In another aspect, a method of driving a plasma display apparatus comprising a plasma display panel including a first electrode, a second electrode, and a third electrode positioned in an intersection direction of the first electrode and the second electrode, a sustain driver that supplies a sustain signal including a positive sustain voltage and a negative sustain voltage to the first electrode during a sustain period, a data driver that supplies a data signal to the third electrode during an address period, a first reference voltage source that is commonly connected to the sustain driver and the second electrode, a second reference voltage source connected to the data driver, and a reference separation controller that separates or connects the first reference voltage source from or to the second reference voltage source, the method comprises supplying the sustain signal to the first electrode by the sustain driver, turning on the reference separation controller during a positive sustain voltage maintenance period when a voltage level of the first electrode is maintained at the positive sustain voltage, so that the first reference voltage source is connected to the second reference voltage source, and turning off the reference separation controller during the remaining period of time except the positive sustain voltage maintenance period from the sustain period, so that the first reference voltage source is separated from the second reference voltage source.

The method may further comprise turning off the data driver during a period of time when the sustain driver supplies the sustain signal to the first electrode so that the data driver is in a hi-impedance state.

The third electrode may be clamped during the positive sustain voltage maintenance period, so that a voltage level of the third electrode is maintained at the data voltage. The third electrode may be floated during the remaining period of time except the positive sustain voltage maintenance period from the sustain period.

A floating voltage of the third electrode may be substantially equal to a sum of the data voltage and the negative sustain voltage during a period of time when the negative sustain voltage is supplied to the first electrode.

The method may further comprise supplying the data voltage to the third electrode by the data driver during a first period of the positive sustain voltage maintenance period, the first period being shorter than the positive sustain voltage maintenance period, supplying a second reference voltage output from the second reference voltage source to the third electrode by the data driver during a second period of the positive sustain voltage maintenance period which follows the first period, and floating the third electrode during the remaining period of time except the positive sustain voltage maintenance period from the sustain period.

In another aspect, a method of driving a plasma display apparatus comprising a plasma display panel including a first electrode, a second electrode, and a third electrode positioned in an intersection direction of the first electrode and the second electrode, the method comprises supplying a positive sustain voltage and a negative sustain voltage of a sustain signal to the first electrode during a sustain period, supplying a data voltage to the third electrode during a first period of a positive sustain voltage maintenance period when a voltage level of the first electrode is maintained at the positive sustain voltage, the first period being shorter than the positive sustain voltage maintenance period, supplying a voltage output from a reference voltage source to the third electrode during a second period of the positive sustain voltage maintenance period which follows the first period, and floating the third electrode during the remaining period of time except the positive sustain voltage maintenance period from the sustain period.

A floating voltage of the third electrode may be substantially equal to a sum of the data voltage and the negative sustain voltage during a period of time when the negative sustain voltage is supplied to the first electrode.

In another aspect, a method of driving a plasma display apparatus comprising a plasma display panel including a first electrode, a second electrode, and a third electrode positioned in an intersection direction of the first electrode and the second electrode, a sustain driver that supplies a sustain signal including a positive sustain voltage and a negative sustain voltage to the first electrode during a sustain period, a data driver that supplies a data signal to the third electrode during an address period, a first reference voltage source that is commonly connected to the sustain driver and the second electrode, a second reference voltage source connected to the data driver, and a reference separation controller that separates or connects the first reference voltage source from or to the second reference voltage source, the method comprises supplying a positive sustain voltage and a negative sustain voltage of a sustain signal to the first electrode during a sustain period, supplying a data voltage to the third electrode during a first period of a positive sustain voltage maintenance period when a voltage level of the first electrode is maintained at the positive sustain voltage, the first period being shorter than the positive sustain voltage maintenance period, supplying a voltage output from a reference voltage source to the third electrode during the remaining period of time except the first period from the sustain period, and turning on the reference separation controller during the positive sustain voltage maintenance period so that a first reference voltage source is connected to a second reference voltage source, and turning off the reference separation controller during the remaining period of time except the positive sustain voltage maintenance period from the sustain period, so that the first reference voltage source is separated from the second reference voltage source.

BRIEF DESCRIPTION OF THE DRAWINGS

The accompanying drawings, which are included to provide a further understanding of the invention and are incorporated on and constitute a part of this specification, illustrate embodiments of the invention and together with the description serve to explain the principles of the invention. In the drawings.

DETAILED DESCRIPTION OF EMBODIMENTS

Reference will now be made in detail embodiments of the invention examples of which are illustrated in the accompanying drawings.

Figure 1:
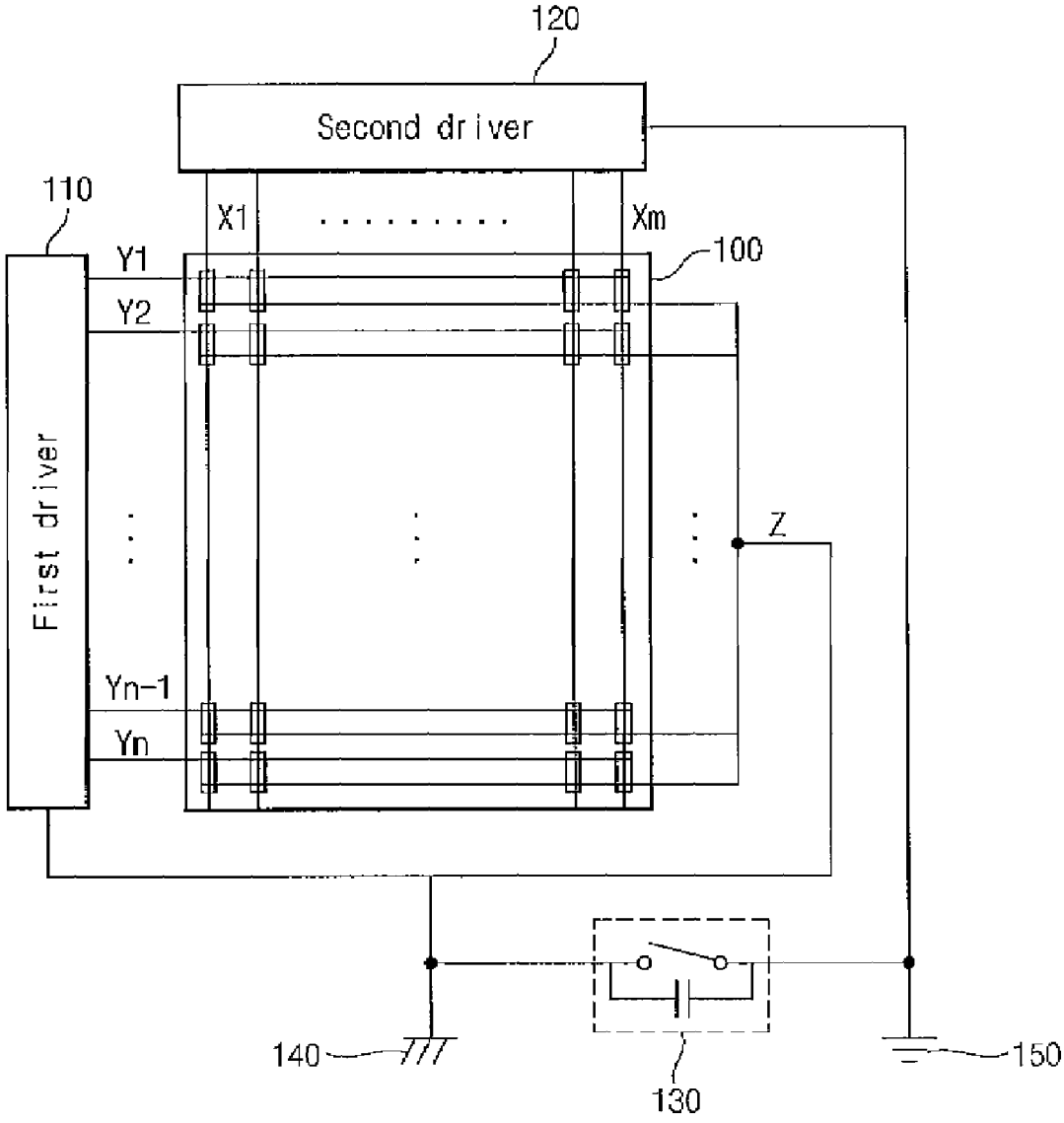
FIG. 1 illustrates a plasma display apparatus according to an exemplary embodiment.

FIG. 1 illustrates a plasma display apparatus according to an exemplary embodiment.

As illustrated in FIG. 1, a plasma display apparatus according to an exemplary embodiment includes a plasma display panel 100, a first driver 110, a second driver 120, and a reference separation controller 130.

The plasma display panel 100 includes first electrodes Y1-Yn, second electrodes Z, and third electrodes X1-Xm positioned in an intersection direction of the first electrodes Y1-Yn and the second electrodes Z. One terminal of the first driver 110 is electrically connected to the first electrodes Y1-Yn, and the other terminal of the first driver 110 and a first reference voltage source 140 are electrically connected to the second electrodes Z. One terminal of the second driver 120 is electrically connected to the third electrodes X1-Xm, and a second reference voltage source 150 is electrically connected to the other terminal of the second driver 120.

The reference separation controller 130 is electrically connected between the first reference voltage source 140 and the second reference voltage source 150.

The first driver 110 includes a sustain driver, and drives the first electrodes Y1-Yn. The sustain driver supplies sustain signals to the first electrodes Y1-Yn, thereby sustaining in a state of a sustain discharge. Hence, an image is displayed.

The first driver 110 may supply a reset signal to the first electrodes Y1-Yn to initialize wall charges distributed in discharge cells. Further, the first driver 110 may supply a scan reference voltage and a scan signal to the first electrodes Y1-Yn.

Voltage sources of the first driver 110 supply voltages based on the first reference voltage source 140. For instance, a sustain voltage source supplying a voltage of a sustain signal and a setup voltage source supplying a setup signal of a reset signal of the first driver 110 supply predetermined voltages based on the first reference voltage source 140.

The first reference voltage source 140 may form a first reference voltage, and may be formed in a predetermined area using an electrically conductive material. For instance, the first reference voltage source 140 may be a frame, and formed in the form of a cooper foil having a predetermined area while being electrically separated from a frame. Further, the first reference voltage source 140 may be formed by attaching an electrically conductive material to a case of the plasma display apparatus. The first reference voltage source 140 may be variously formed.

The second driver 120 includes a data driver, and supplies a data signal to the third electrodes X1-Xm.

A data voltage sources of the second driver 120 supplies a data voltage of a data signal based on the second reference voltage source 150.

The second reference voltage source 150 may form a second reference voltage while being electrically separated from the first reference voltage source 140, in the same way as the first reference voltage source 140. The second reference voltage source 150 may be variously formed in the same way as the first reference voltage source 140.

The reference separation controller 130 separates the first reference voltage source 140 connected to the sustain driver from the second reference voltage source 150 connected to the data driver. The reference separation controller 130 may include a parasitic capacitor Csw virtually generated by a switch.

As above, since the first reference voltage source 140 is separated from the second reference voltage source 150 by the reference separation controller 130 positioned therebetween, an intensity of an opposite discharge generated inside the discharge cell may be reduced during a period of time when the sustain driver supplies a sustain signal to the first electrodes Y1-Yn.

When the reference separation controller 130 electrically separates the first reference voltage source 140 from the second reference voltage source 150, there occurs a voltage difference between the first reference voltage source 140 and the second reference voltage source 150. Hence, the third electrodes X1-Xm are floated depending on a change in a sustain signal. An intensity of an opposite discharge is reduced due to a floating voltage produced by the third electrodes X1-Xm in a floating state, and a damage to a phosphor caused by the opposite discharge is prevented.

Accordingly, a discharge efficiency and a driving efficiency can increase by preventing the damage of the phosphor. Furthermore, life span of the plasma display apparatus can increase.

Figure 2:
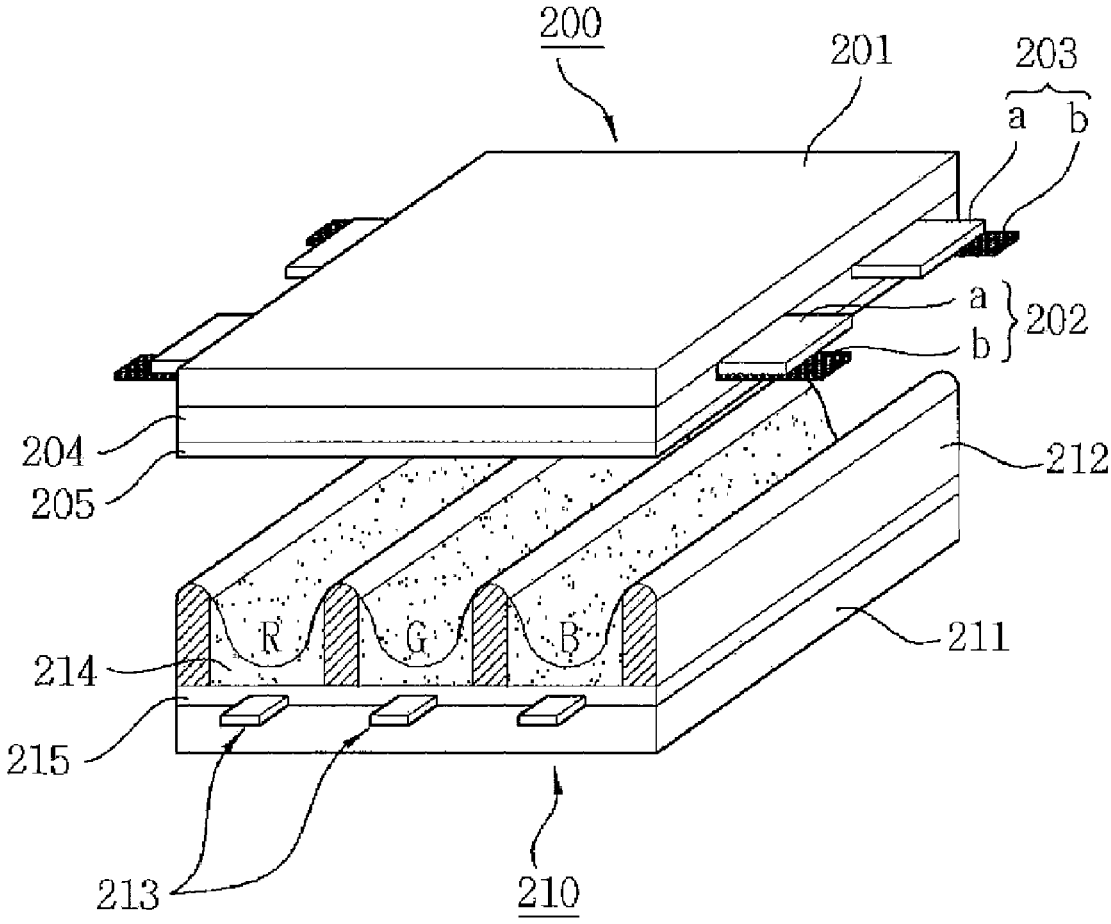
FIG. 2 illustrates the structure of a plasma display panel of FIG. 1.

FIG. 2 illustrates the structure of the plasma display panel 100 of FIG. 1.

As illustrated in FIG. 2, the plasma display panel 100 includes a front panel 200 and a rear panel 210 which are coupled in parallel to oppose to each other at a given distance therebetween. The front panel 200 includes a front substrate 201 being a display surface on which an image is displayed. The rear panel 210 includes a rear substrate 211 constituting a rear surface. A plurality of first electrodes 202 and a plurality of second electrodes 203 are formed in pairs on the front substrate 201. A plurality of third electrodes 213 are arranged on the rear substrate 211 to intersect the first electrodes 202 and the second electrodes 203.

The first electrode 202 and the second electrode 203 each include transparent electrodes 202*a* and 203*a* made of a transparent material, for instance, indium-tin-oxide (ITO) and bus electrodes 202*b* and 203*b* made of a metal material. The first electrode 202 and the second electrode 203 generate a mutual discharge therebetween in one discharge cell and maintain light-emissions of the discharge cells. The first electrode 202 and the second electrode 203 are covered with one or more upper dielectric layers 204 for limiting a discharge current and providing electrical insulation between the first electrode 202 and the second electrode 203. A protective layer 205 with a deposit of MgO is formed on an upper surface of the upper dielectric layer 204 to facilitate discharge conditions.

A plurality of stripe-type (or well-type) barrier ribs 212 are formed in parallel on the rear substrate 211 to form a plurality of discharge spaces (i.e., a plurality of discharge cells). The plurality of third electrodes 213 for performing an address discharge to generate vacuum ultraviolet rays are arranged in parallel to the barrier ribs 212. An upper surface of the rear substrate 211 is coated with red (R), green (G) and blue (B) phosphors 214 for emitting visible light for an image display during the generation of an address discharge. A lower dielectric layer 215 is formed between the third electrodes 213 and the phosphors 214 to protect the third electrodes 213.

FIG. 2 illustrated only an example of the plasma display panel 100 applicable to an exemplary embodiment. Accordingly, an exemplary embodiment is not limited to the structure of the plasma display panel illustrated in FIG. 2.

For instance, in FIG. 2, the first electrode 202 and the second electrode 203 each include the transparent electrodes 202*a* and 203*a* and the bus electrodes 202*b* and 203*b*. However, at least one of the first electrode 202 and the second electrode 203 may include only the bus electrode.

Further, FIG. 2 illustrated the upper dielectric layer 204 having a constant thickness. However, the upper dielectric layer 204 may have a different thickness and a different dielectric constant in each area. FIG. 2 illustrated the barrier ribs 212 having a constant interval between the barrier ribs. However, an interval between the barrier ribs 112 forming the blue discharge cell (B) may be larger than intervals between the barrier ribs 112 forming the red and green discharge cells (R and G).

Further, a luminance of an image displayed on the plasma display panel 100 can increase by forming the side of the barrier rib 112 in a concavo-convex shape and coating the phosphor 214 depending on the concavo-convex shape of the barrier rib 112.

A tunnel may be formed on the side of the barrier rib 112 so as to improve an exhaust characteristic when the plasma display panel is fabricated.

Figure 3:
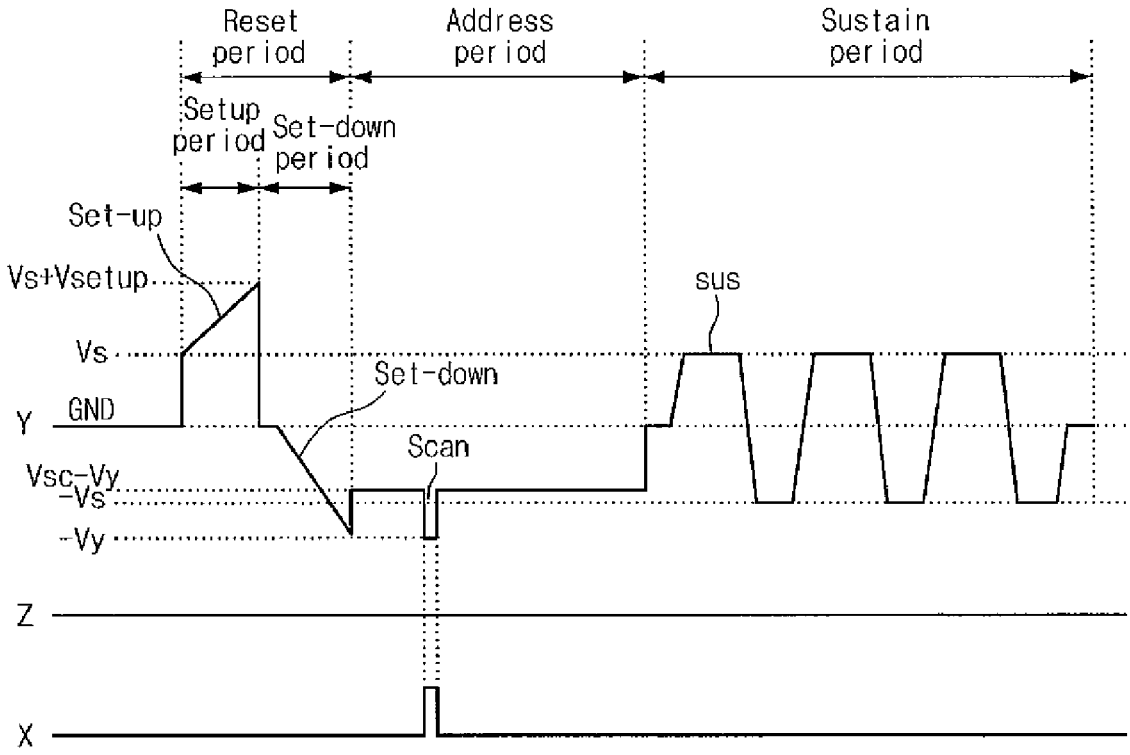
FIG. 3 illustrates a method of driving a plasma display apparatus according to an exemplary embodiment.

FIG. 3 illustrates a method of driving the electrodes of the plasma display panel 100 by the drivers 110 and 120.

As illustrated in FIG. 3, the first and second drivers 110 and 120 of FIG. 1 supply driving signals to the first electrode Y and the third electrode X during at least one of a reset period, an address period, and a sustain period.

The reset period is divided into a setup period and a set down period. During the setup period, the first driver 110 may supply a setup signal (Set-up) to the first electrode Y. The setup signal generates a weak dark discharge within the discharge cells of the whole screen. This results in wall charges of a positive polarity being accumulated on the second electrode Z and the third electrode X, and wall charges of a negative polarity being accumulated on the first electrode Y.

During the set down period, the first driver 110 may supply a set-down signal (Set-down) which falls from a positive voltage level lower than the highest voltage of the setup signal (Set-up) to a given voltage level lower than a ground level voltage GND to the first electrode Y, thereby generating a weak erase discharge within the discharge cells. Furthermore, the remaining wall charges are uniform inside the discharge cells to the extent that the address discharge can be stably performed.

During the address period, the first driver 110 may supply a scan signal (Scan) of a negative polarity falling from a scan bias voltage (Vsc-Vy) to the first electrode Y. The second driver 120 may supply a data signal of a positive polarity to the third electrode X in synchronization with the scan signal (Scan). As a voltage difference between the scan signal (Scan) and the data signal is added to the wall voltage generated during the reset period, an address discharge is generated within the discharge cells to which the data signal is applied. Wall charges are formed inside the discharge cells selected by performing the address discharge to the extent that a discharge occurs whenever a sustain voltage Vs is applied. Hence, the first electrode Y is scanned.

During the sustain period, the first driver 110 may supply a sustain signal (sus) to the first electrode Y. As the wall voltage inside the discharge cells selected by performing the address discharge is added to the sustain signal (sus), every time the sustain signal (sus) is applied, a sustain discharge, i.e., a display discharge is generated between the first electrode Y and the second electrode Z.

An erase period may be added in an exemplary embodiment.

Figure 4:
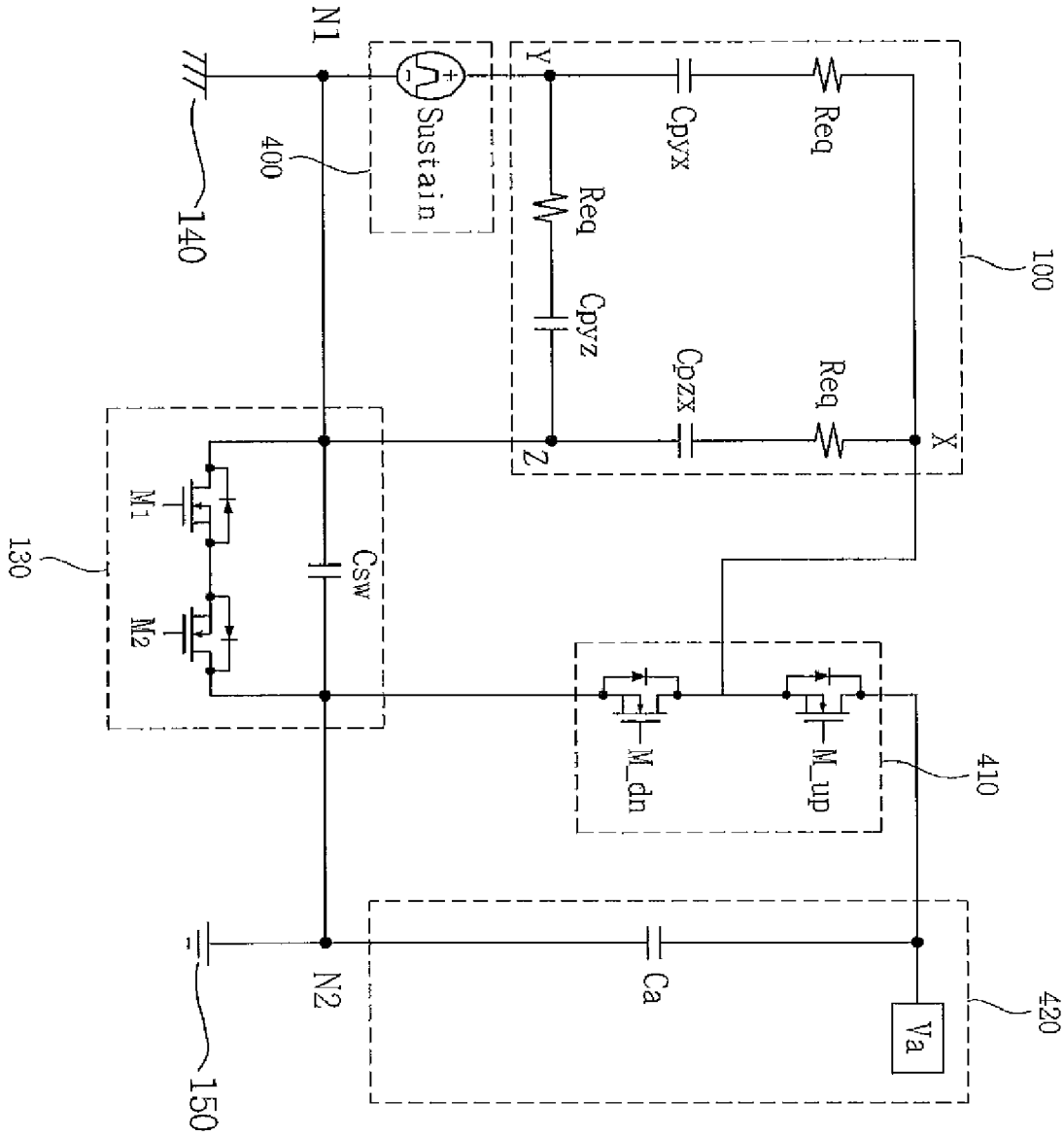
FIG. 4 illustrates an operation of a plasma display apparatus during a sustain period of FIG. 3.

FIG. 4 illustrates an operation of a plasma display apparatus during a sustain period of FIG. 3.

As illustrated in FIG. 4, the plasma display apparatus includes the plasma display panel 400, a sustain driver 400, a data driver 410, a data constant voltage source 420, and the reference separation controller 130.

As described above, the plasma display panel 400 includes a YZ capacitor Cpyz between the first electrode Y and the second electrode Z, a ZX capacitor Cpzx between the second electrode Z and the third electrode X, a YX capacitor Cpyx between the first electrode Y and the third electrode X, and an equivalent resistor Req with respect to the capacitors Cpyz, Cpzx and Cpyx.

One terminal of the sustain driver 400 is connected to the first electrode Y, and the other terminal is commonly connected to the first reference voltage source 140, the second electrode Z, and one terminal of the reference separation controller 130. The sustain driver 400 supplies a sustain signal including a positive sustain voltage Vs and a negative sustain voltage −Vs to the first electrode Y during a sustain period.

A power supply (not shown) of the sustain driver 400 is connected to the first reference voltage source 140.

The data driver 410 includes a top switch M_up and a bottom switch M_dn. One terminal of the top switch M_up is connected to the third electrode X, and the other terminal is connected to the data constant voltage source 420. The top switch M_up controls the supply of a data voltage Va output from the data constant voltage source 420 to the third electrode X. One terminal of the bottom switch M_dn is commonly connected to the third electrode X and one terminal of the top switch M_up, and the other terminal is commonly connected to the other terminal of the reference separation controller 130 and the second reference voltage source 150. The bottom switch M_dn controls the supply of a second reference voltage output from the second reference voltage source 150 to the third electrode X.

A power supply of the data driver 410 may be connected to the second reference voltage source 150 through a capacitor Ca included in the data constant voltage source 420.

The reference separation controller 130 includes reference separation switches M1 and M2. The reference separation controller 130 may include a parasitic capacitor Csw parasitically generated in the reference separation switches M1 and M2.

The reference separation switches M1 and M2 may be a switching element including a body diode. In this case, anodes of body diodes of two switching elements may be connected to each other, or cathodes may be connected to each other.

FIG. 4 illustrates an equivalent circuit of the reference separation controller 130.

One terminal of each of the reference separation switches M1 and M2 is commonly connected to the other terminal of the sustain driver 400, the first reference voltage source 140, and the second electrode Z, and the other terminal is commonly connected to the second reference voltage source 150, the other terminal of the bottom switch M_dn, the data constant voltage source 420. The reference separation switches M1 and M2 separate the first reference voltage source 140 from the second reference voltage source 150.

For instance, the reference separation switches M1 and M2 are turned on during a positive sustain voltage maintenance period when a voltage level of the first electrode Y is maintained at the positive sustain voltage, so that the first reference voltage source 140 is connected to the second reference voltage source 150. The reference separation switches M1 and M2 are turned off during the remaining period excluding the positive sustain voltage maintenance period from the sustain period, so that the first reference voltage source 140 is separated from the second reference voltage source 150.

As above, since the reference separation controller 130 separates the first reference voltage source 140 from the second reference voltage source 150, the sustain driver 400 can cause the third electrode X to be floated during the remaining period except the positive sustain voltage maintenance period from the sustain period.

One terminal of a capacitor Ca of the data constant voltage source 420 is commonly connected to the data constant voltage source 420 and the other terminal of the top switch M_up, and the other terminal is commonly connected to the other terminal of the bottom switch M_dn, the second reference voltage source 150, and the other terminal of the reference separation controller 130.

Figure 5:
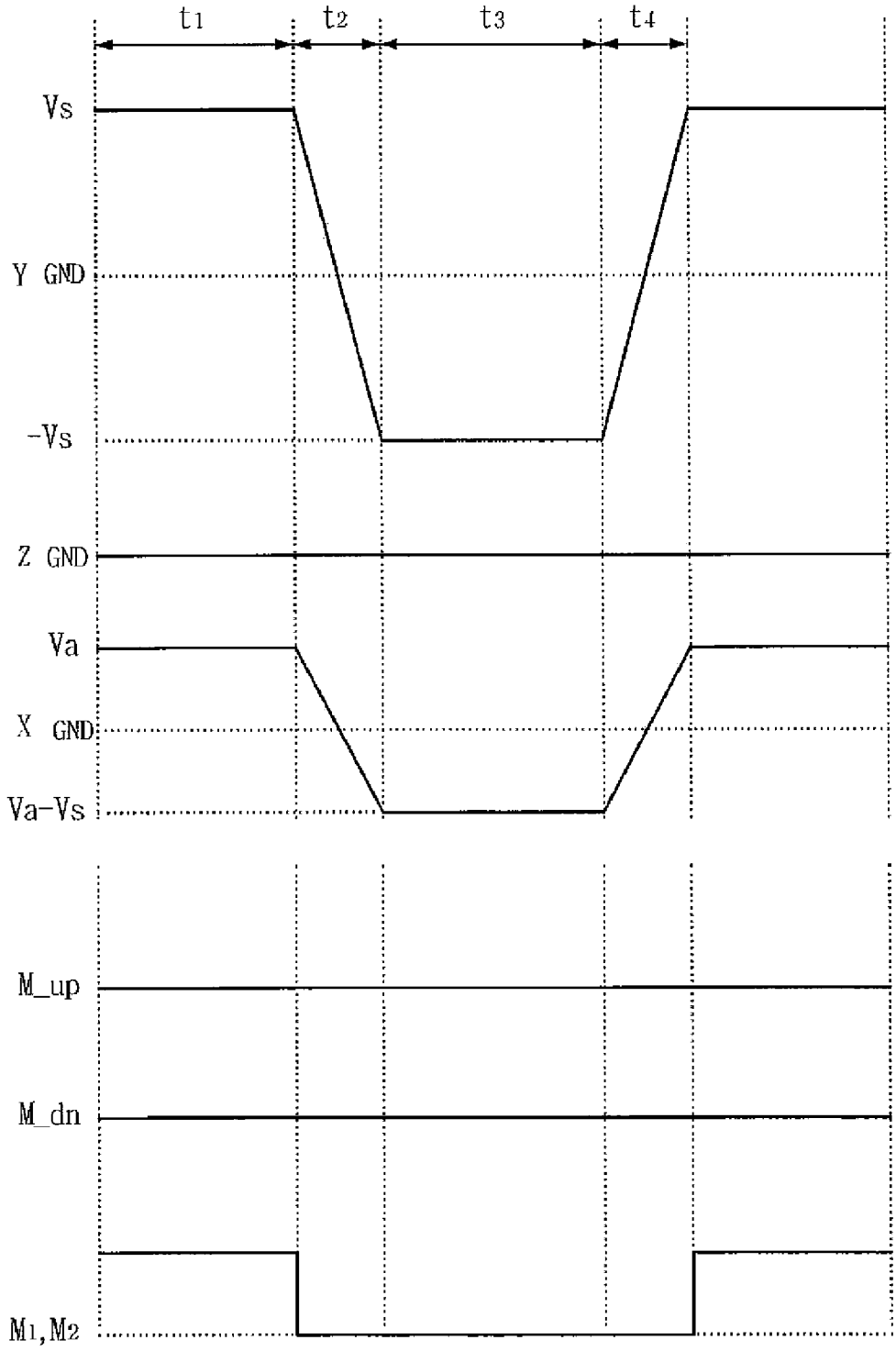
FIG. 5 illustrates a timing diagram and an output voltage for explaining a method of driving a plasma display apparatus during a sustain period.

FIG. 5 illustrates a timing diagram and an output voltage for explaining a method of driving a plasma display apparatus during a sustain period.

Figure 6A:
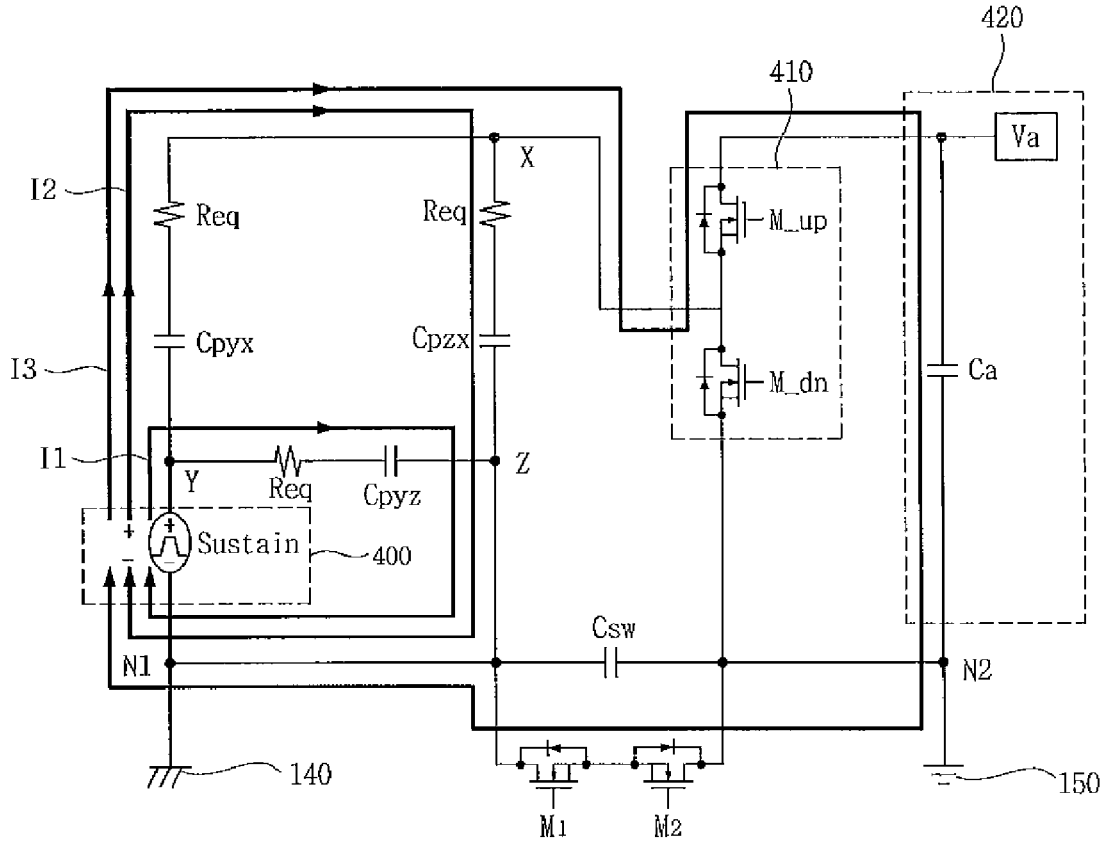
FIGS. 6A to 6C illustrate a method for operating the plasma display apparatus of FIG. 4 depending on the timing diagram of FIG. 5.
Figure 6B:
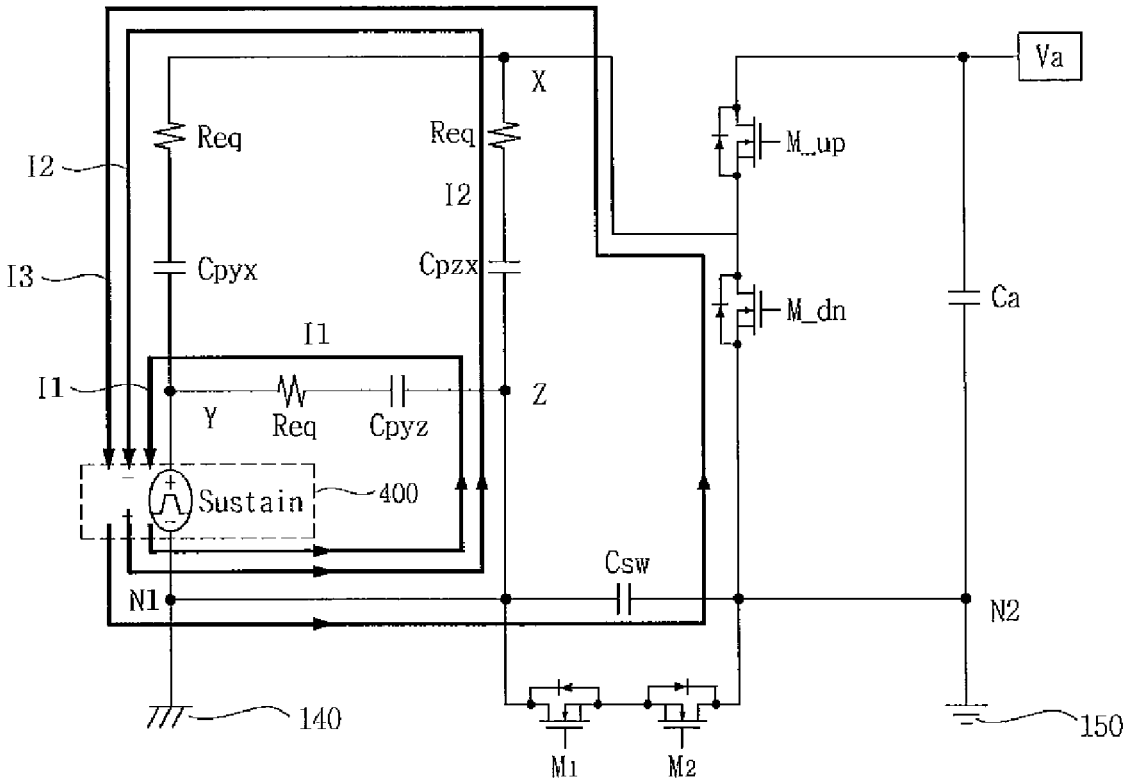
Figure 6C:
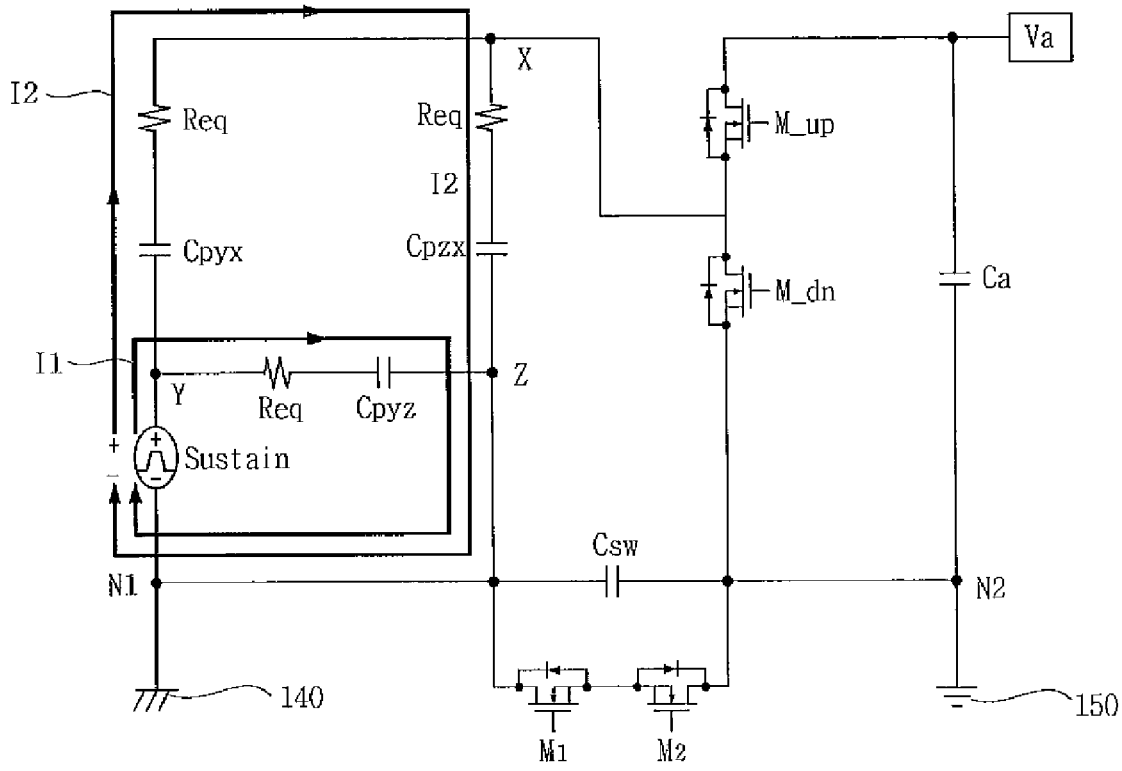

FIGS. 6A to 6C illustrate a method for operating the plasma display apparatus of FIG. 4 depending on the timing diagram of FIG. 5.

As illustrated in FIG. 5, the sustain driver 400 supplies a sustain signal alternately having the positive sustain voltage Vs and the negative sustain voltage −Vs to the first electrode Y based on the first reference voltage source 140 during a sustain period.

An absolute value of the positive sustain voltage Vs is substantially equal to an absolute value of the negative sustain voltage −Vs.

As above, the second electrode Z is connected to the first reference voltage source 140 during a period of time when the sustain driver 400 supplies the sustain signal to the first electrode Y, thereby receiving a first voltage output from the first reference voltage source 140.

The top switch M_up and the bottom switch M_dn are turned off during periods t1, t2, t3, and t4 when the sustain driver 400 supplies the sustain signal alternately having the positive sustain voltage Vs and the negative sustain voltage −Vs to the first electrode Y so that the data driver 410 is in a hi-impedance state.

The reference separation switches M1 and M2 are turned on during the period t1 when a voltage level of the first electrode Y is maintained at the positive sustain voltage Vs so that the first reference voltage source 140 is connected to the second reference voltage source 150. Accordingly, a first node N1 of the first reference voltage source 140 and a second node N2 of the second reference voltage source 150 have an equal voltage level during the period t1. Hence, the third electrode X is clamped during the period t1 so that a voltage level of the third electrode X is maintained at the data voltage Va.

A magnitude of the voltage level (i.e., the data voltage Va) of the third electrode X during the period t1 is substantially equal to a magnitude of the data voltage Va of the data signal supplied to the third electrode X during an address period.

During the periods t2, t3 and t4, the reference separation switches M1 and M2 are turned off so that the first reference voltage source 140 is separated from the second reference voltage source 150

Since the first node N1 of the first reference voltage source 140 and the second node N2 of the second reference voltage source 150 may have different voltage levels during the periods t2, t3 and t4, the third electrode X may be floated.

In such a case, a floating voltage of the third electrode X based on the first reference voltage source 140 during the period t3 when a voltage level of the first electrode Y is maintained at the negative sustain voltage −Vs is substantially equal to a voltage (Va−Vs) corresponding to a sum of the data voltage Va and the negative sustain voltage −Vs.

A voltage level of the third electrode X has a voltage level ranging from a voltage Va to a voltage (Va−Vs) during the sustain period. The voltage Va is different from the sustain voltage Vs.

As above, since a signal having a waveform similar to a waveform of the sustain signal is supplied to the third electrode X during the sustain period, an opposite discharge generated when a discharge repeatedly occurs inside the discharge cell is suppressed.

In case that the opposite discharge is maintained for a long period of time, the phosphor inside the discharge cell may be damaged. Hence, the driving characteristic and life span of the plasma display panel are reduced.

More specifically, when a voltage level of the first electrode Y rises to the positive sustain voltage Vs, as the wall voltage produced inside the discharge cells during the address period is added to the positive sustain voltage Vs, a surface discharge is generated between the first electrode Y and the second electrode Z. In such a case, the opposite discharge does not occur between the first electrode Y and the third electrode X because the third electrode X is clamped. More specifically, when the voltage Va is supplied to the third electrode X in a clamping state of the third electrode X, the opposite discharge is suppressed due to a reduction in the voltage difference between the first electrode Y and the third electrode X.

When a voltage difference between the first electrode Y and the second electrode Z falls to the negative sustain voltage −Vs, an opposite discharge is suppressed though a voltage level of the third electrode X is the voltage (Va−Vs).

FIG. 6A illustrates a circuit operation of the plasma display apparatus during the period t1. During the period t1, the top switch M_up and the bottom switch M_dn are in a turn off state, the reference separation switches M1 and M2 are turned on, the sustain driver 400 supplies the positive sustain voltage Vs to the first electrode Y. Hence, a voltage level of the first electrode Y is maintained at the positive sustain voltage Vs, and as illustrated in FIG. 6A, first, second and third current paths I1, I2 and I3 may be formed.

Since the top switch M_up and the bottom switch M_dn are in the turn-off state, the data driver 410 is in a hi-impedance state. Accordingly, the data voltage Va of the data constant voltage source 420 may be supplied to the third electrode X through the top switch M_up, or the second reference voltage of the second reference voltage source 150 may not be supplied to the third electrode X through the bottom switch M_dn. When a voltage level of the third electrode X is higher than the data voltage Va, a current flows in an internal diode of the top switch M_up and a current path is formed.

The reference separation switches M1 and M2 are turned on. Hence, the first node N1 of the first reference voltage source 140 and the second node N2 of the second reference voltage source 150 have an equal voltage level.

The sustain signal is supplied to the first electrode Y through the first current path I1, and thus, a voltage level of the first electrode Y is maintained at the positive sustain voltage Vs.

Accordingly, a voltage level of the first electrode Y is maintained at the positive sustain voltage Vs based on the first reference voltage source 140. Further a voltage level of the second electrode Z is the first reference voltage (i.e., 0V) because the first reference voltage of the first reference voltage source 140 is supplied to the second electrode Z.

A sum of voltages of the first, second and third electrodes Y, Z and X must be 0 due to Kirchhoff's Current Law (KCL). Accordingly, since a voltage difference between the first electrode Y and the second electrode Z is Vs, a sum of a voltage difference between the first electrode Y and the third electrode X and a voltage difference between the second electrode Z and the third electrode X is Vs.

Since the equivalent capacitor Cpyx between the first electrode Y and the third electrode X and the equivalent capacitor Cpzx between the second electrode Z and the third electrode X have a substantially equal value, a voltage difference between the first electrode Y and the third electrode X and a voltage difference between the second electrode Z and the third electrode X have an equal voltage of Vs/2. Therefore, a voltage of the third electrode X is Vs/2. In this case, a voltage of the third electrode X is clamped from a voltage of Vs/2 to the data voltage Va through the third current path T3.

In other words, when a voltage higher than the data voltage Va is supplied to the third electrode X through the third current path I3, a current flows into an internal diode of the top switch M_up until a voltage of the third electrode X falls from the voltage higher than the data voltage Va to the data voltage Va. As a result, a voltage of the third electrode X is clamped to the data voltage Va.

Accordingly, since a voltage difference between the first electrode Y and the third electrode X is equal to Vs−Va and a voltage difference between the second electrode Z and the third electrode X is equal to Va, a voltage of the third electrode X is equal to Va based on the first reference voltage source 140.

In this case, since the first electrode Y is greatly contributed to a discharge, a surface discharge occurs between the first electrode Y and the second electrode Z. An intensity of an opposite discharge generated between the first electrode Y and the third electrode X is reduced because the voltage difference between the first electrode Y and the third electrode X is reduced to Vs−Va due to the clamping effect.

During the periods t2 and t3, the top witch M_up and the bottom switch M_dn remain a turn-off state, the reference separation switches M1 and M2 are turned off, the sustain driver 400 supplies the sustain signal to the second electrode Z. Hence, as illustrated in FIG. 6B, first, second and third current paths I1, I2, and I3 are formed.

During the period t2, the positive sustain voltage (+Vs) is supplied to the first reference voltage source 140 along the first current path I1, and the first reference voltage of the first reference voltage source 140 is supplied to the second electrode Z. The first reference voltage is higher than a voltage level of the first electrode by a voltage magnitude of Vs.

Accordingly, a voltage level of the first electrode Y falls from the positive sustain voltage (+Vs) to the negative sustain voltage (−Vs) based on the first reference voltage source 140. Further, a voltage difference between the first electrode Y and the second electrode z falls from +Vs to −Vs, and a voltage difference between the first electrode Y and the third electrode X falls from Vs−Va to −Va.

Further, a voltage difference between the third electrode X and the second electrode Z falls from Va to Va−Vs, and a floating voltage of the third electrode X falls from Va to Va−Vs based on the first reference voltage source 140.

At this time, since the first reference voltage is supplied to the second electrode Z, a voltage level of the second electrode Z is maintained at the first reference voltage based on the first reference voltage source 140.

Accordingly, since the reference separation switches M1 and M2 are turned off, the third electrode X is floated and the floating voltage of the third electrode X is reduced from Va to Va−Vs based on the first reference voltage source 140.

During the period t3, a voltage level of the first electrode Y falling to the negative sustain voltage −Vs based on the first reference voltage source 140 is maintained at the negative sustain voltage −Vs, and a voltage level of the third electrode X is maintained at Va−Vs.

As above, the floating voltage of the third electrode X is substantially equal to a sum (Va−Vs) of the data voltage Va and the negative sustain voltage −Vs during the period t3 when the negative sustain voltage −Vs is supplied to the first electrode Y.

In this case, since the second electrode Z is greatly contributed to a discharge, a surface discharge occurs between the first electrode Y and the second electrode Z. An intensity of an opposite discharge generated between the second electrode Z and the third electrode X is reduced because the voltage difference between the second electrode Z and the third electrode X is reduced to Vs−Va due to the third electrode X in the floating state.

During the period t4, the top witch M_up, the bottom switch M_dn, and the reference separation switches M1 and M2 remain a turn-off state, and the sustain driver 400 supplies the sustain signal to the first electrode Y.

As illustrated in FIG. 6C, first and second current paths I1 and I2 are formed.

A voltage is supplied to the first electrode Y along the first current path I1, and a voltage level of the first electrode Y rises from the negative sustain voltage −Vs to the positive sustain voltage Vs based on the first reference voltage source 140.

A voltage level of the third electrode Z rises from Va−Vs to the data voltage Va based on the first reference voltage source 140.

In this case, the voltage difference between the first electrode Y and the third electrode Z changes from −Va to Vs−Va.

As above, during the periods t2, t3 and t4 except the period t1, the reference separation switches M1 and M2 are turned off, and the third electrode X is floated depending on the sustain signal supplied by the sustain driver 400.

As a result, the intensity of the opposite discharge is reduced and a damage to the phosphor is prevented, and thus life span of the plasma display panel 100 can increase. Further, the surface discharge stable occurs, and thus the driving efficiency during the sustain period can be improved.

Figure 7:
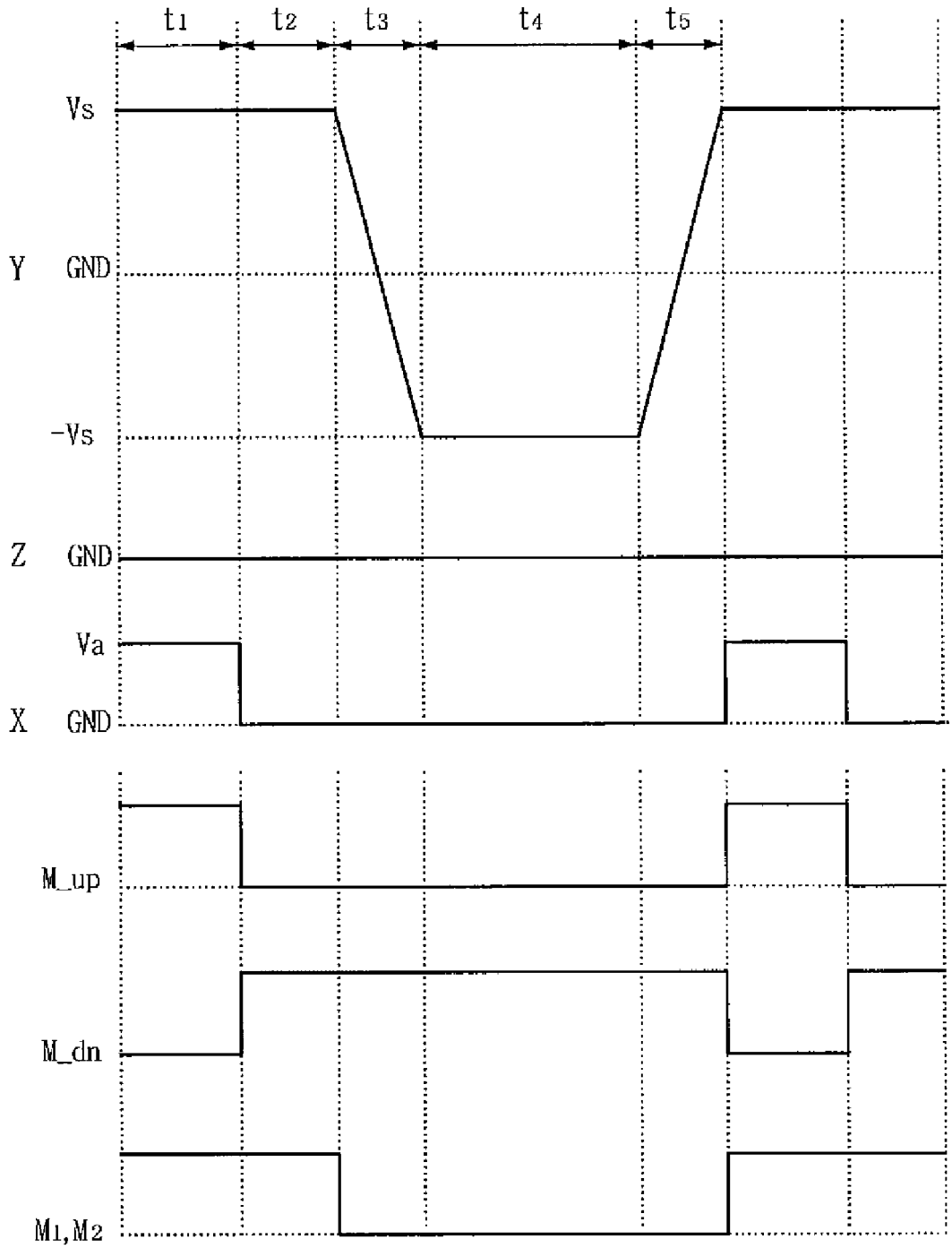
FIG. 7 illustrates a timing diagram and an output voltage for explaining a method of driving a plasma display apparatus during a sustain period.

FIG. 7 illustrates a timing diagram and an output voltage for explaining a method of driving a plasma display apparatus during a sustain period.

Figure 8A:
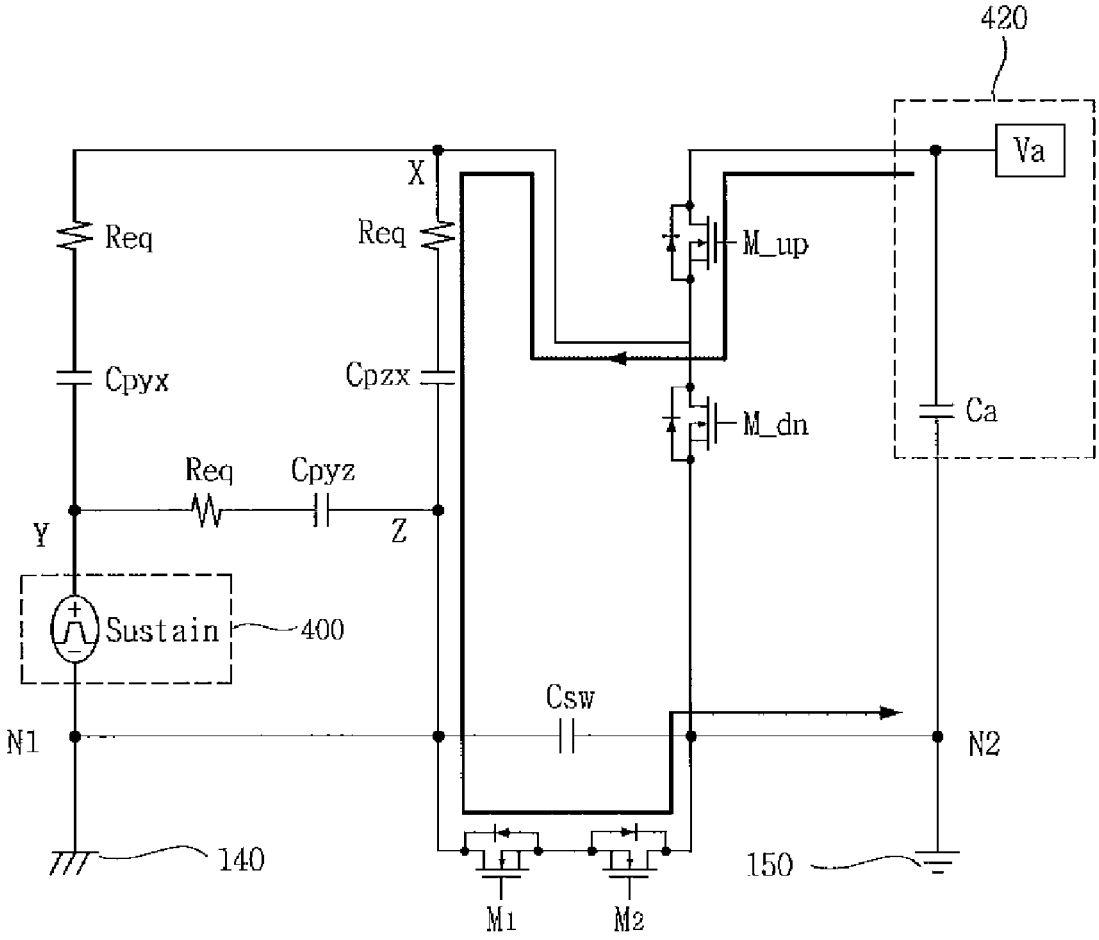
FIGS. 8A to 8C illustrate a method for operating the plasma display apparatus of FIG. 4 depending on the timing diagram of FIG. 7.
Figure 8B:
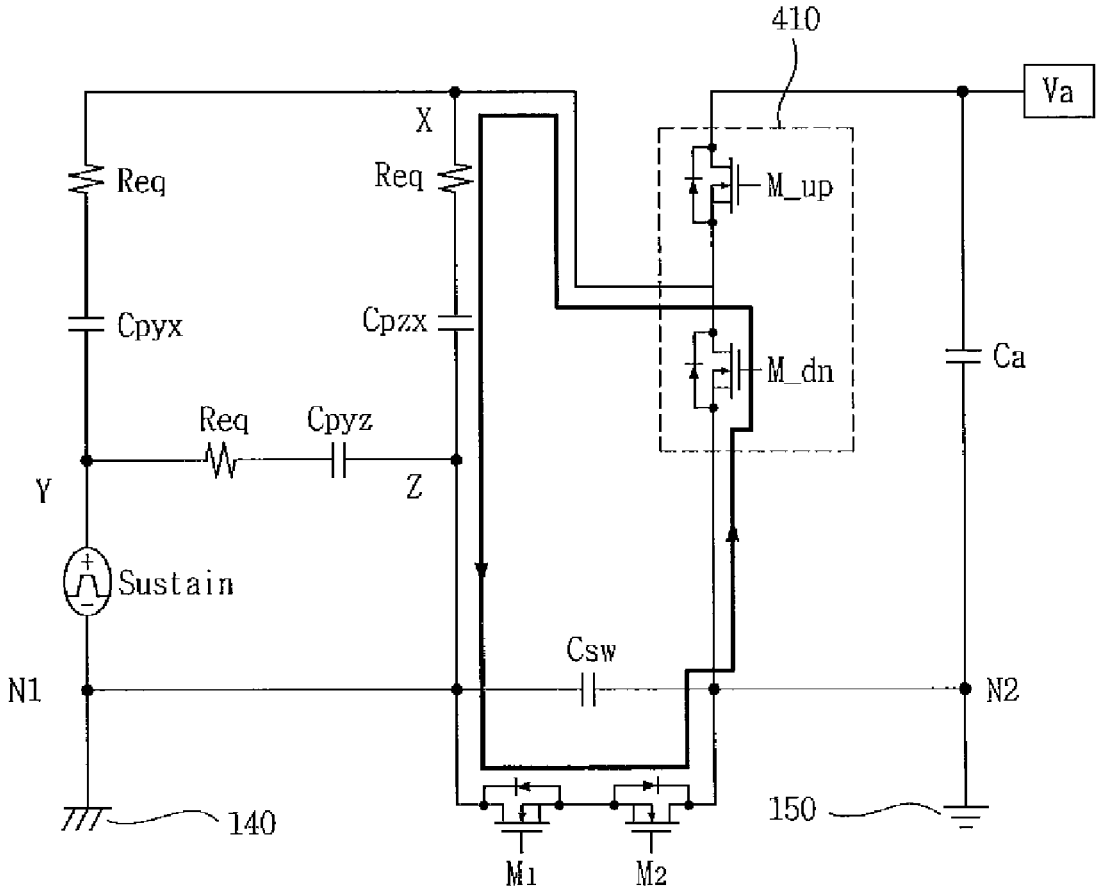
Figure 8C:
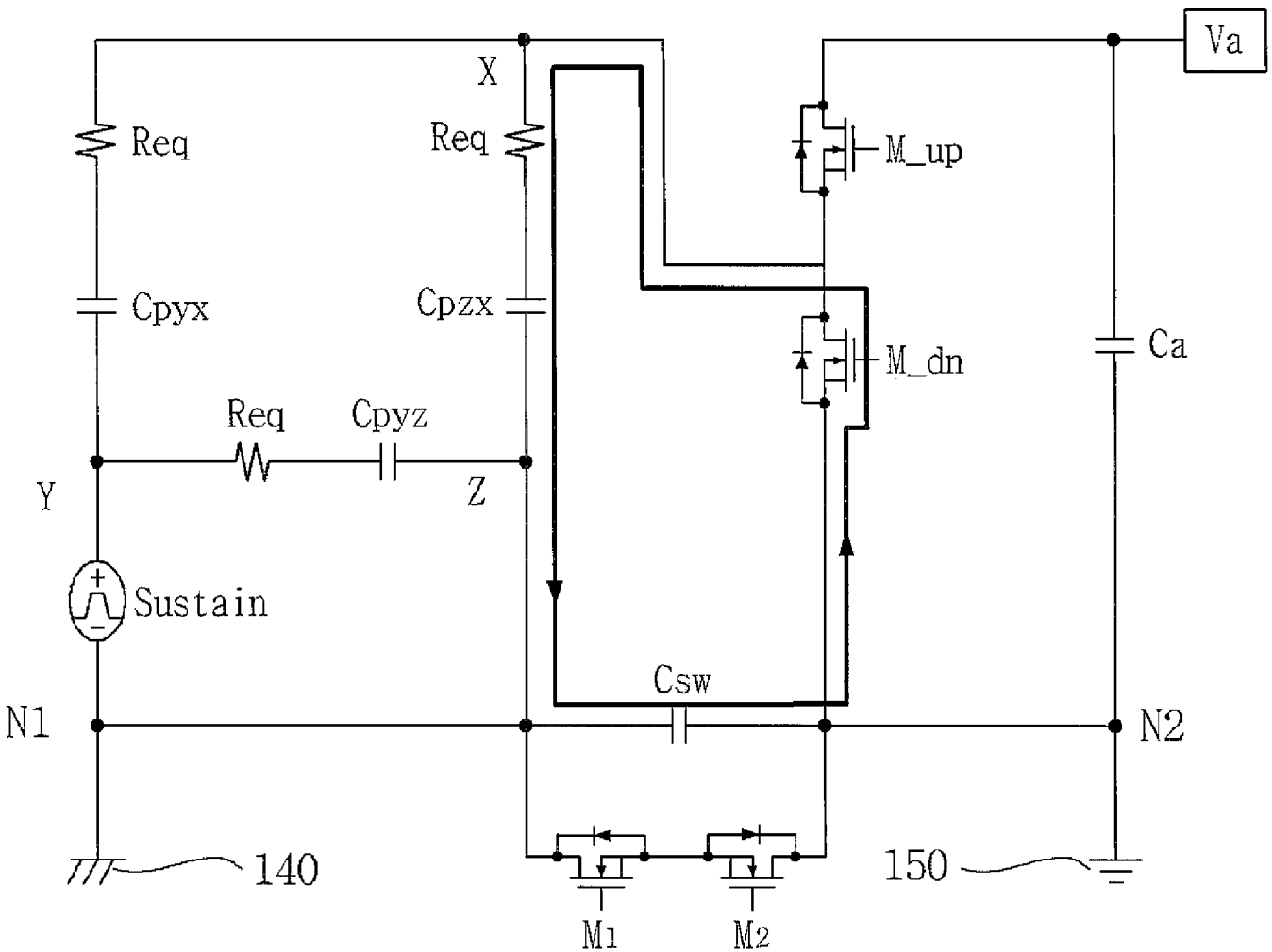

FIGS. 8A to 8C illustrate a method for operating the plasma display apparatus of FIG. 4 depending on the timing diagram of FIG. 7.

As illustrated in FIG. 7, during the sustain period, the sustain driver 400 supplies the sustain signal to the first electrode Y based on the first reference voltage source 140, and thus a voltage level of the first electrode Y alternately has the voltages Vs and −Vs. Further, a voltage level of the second electrode Z is maintained at the first reference voltage based on the first reference voltage source 140.

A voltage level of the first electrode Y is maintained at the positive sustain voltage Vs during periods t1 and t2, and the data voltage Va is supplied to the third electrode X during the period t1. The second reference voltage is supplied to the third electrode X during the periods t2 to t5.

In FIG. 7, a voltage output to the third electrode X corresponds to a voltage level of the third electrode X based on the second reference voltage source 150.

The reference separation switches M1 and M2 are turned on during the periods t1 and t2 when the voltage difference between the first electrode Y and the second electrode Z is maintained at the positive sustain voltage Vs so that the first reference voltage source 140 is connected to the second reference voltage source 150. The reference separation switches M1 and M2 are turned off during the periods t3 to t5 so that the first reference voltage source 140 is separated from the second reference voltage source 150.

FIG. 8A illustrates a circuit operation of the plasma display apparatus during the period t1. During the period t1, the top switch M_up and the reference separation switches M1 and M2 are turned on, the sustain driver 400 supplies the positive sustain voltage Vs to the first electrode Y. Hence, a voltage level of the first electrode Y is maintained at the positive sustain voltage Vs.

Since a current path of the sustain signal supplied to the first electrode Y was described above, a description thereof is omitted and the data voltage Va supplied to the third electrode X will be described below.

When the top switch M_up and the reference separation switches M1 and M2 are turned on during the period t1, a current path illustrated in FIG. 8A is formed.

The data voltage Va output from the data constant voltage source 420 is supplied to the third electrode X through the top switch M_up along the current path of FIG. 8A.

Since the reference separation switches M1 and M2 are turned on during the period t1, the first node N1 of the first reference voltage source 140 and the second node N2 of the second reference voltage source 150 have a substantially equal voltage level.

During the period t2, the bottom switch M_dn is turned on and the reference separation switches M1 and M2 remain in a turn-on state. Hence, a current path illustrated in FIG. 8B is formed.

The data driver 410 supplies the second reference voltage output from the second reference voltage source 150 to the third electrode X along the current path of FIG. 8B. In this case, since the reference separation switches M1 and M2 are turned on during the period t2, the first node N1 of the first reference voltage source 140 and the second node N2 of the second reference voltage source 150 have a substantially equal voltage level.

During the period t3, the bottom switch M_dn remains in a turn-on state, and the reference separation switches M1 and M2 are turned off. Hence, a current path illustrated in FIG. 8C is formed.

Since the first reference voltage source 140 and the second reference voltage source 150 are separated from each other during the period t3, the first node N1 and the second node N2 have different voltage levels.

However, a voltage level of the third electrode X is equal to the second reference voltage of the second reference voltage source 150 because the bottom switch M_dn remains in a turn-on state.

During the periods t4 and t5, the current path illustrated in FIG. 8C is formed.

Figure 9:
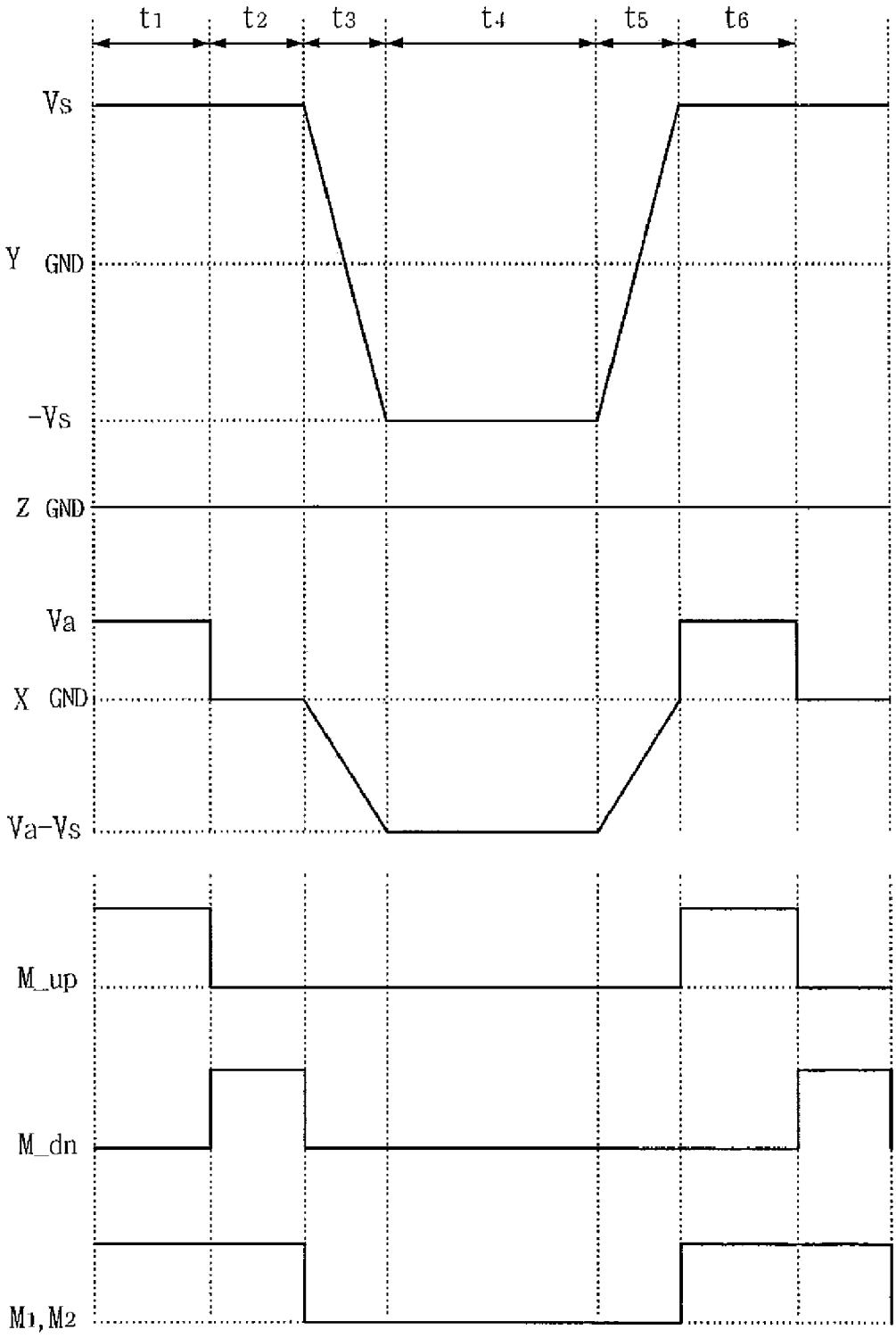
FIG. 9 illustrates a timing diagram and an output voltage for explaining another method of driving a plasma display apparatus during a sustain period.

FIG. 9 illustrates a timing diagram and an output voltage for explaining another method of driving a plasma display apparatus during a sustain period.

As illustrated in FIG. 9, the driving method of the plasma display panel includes supplying the sustain signal having the positive sustain voltage Vs and the negative sustain voltage −Vs to the first electrode Y during a sustain period; a voltage level of the first electrode Y is maintained at the positive sustain voltage Vs during periods t1 and t2 of the sustain period and the data voltage Va is supplied to the third electrode X during the period t1; a voltage output from the second reference voltage source 150 is supplied to the third electrode X during the period t2; and the third electrode X is floated during periods t3 to t5 except the periods t1 and t2 from the sustain period.

More specifically, the sustain driver 400 supplies the sustain signal to the first electrode Y during the sustain period. The reference separation switches M1 and M2 are turned on during the periods t1 and t2, when a voltage level of the first electrode Y is maintained at positive sustain voltage Vs based on the first reference voltage source 140, so that the first reference voltage source 140 is connected to the second reference voltage source 150. The reference separation switches M1 and M2 are turned off during the periods t3 to t5 so that the first reference voltage source 140 is separated from the second reference voltage source 150.

The top switch M_up is turned on during the period t1 so that the data driver 410 supplies the data voltage Va to the third electrode X. The bottom switch M_dn is turned on during the period t2 so that the data driver 410 supplies the second reference voltage output from the second reference voltage source 150 to the third electrode X.

At this time, a floating voltage of the third electrode X during the period t4, when a voltage level of the first electrode Y is maintained at the negative sustain voltage −Vs, is substantially a voltage (Va−Vs) equal to a sum of the data voltage Va and the negative sustain voltage −Vs.

Accordingly, the plasma display apparatus can be driven by combining two type driving methods illustrated in FIGS. 5 and 7.

More specifically, the driving method of the plasma display apparatus includes maintaining a voltage level of the first electrode Y at the positive sustain voltage Vs based on the first reference voltage source 140 during the periods t1 and t2; lowering a voltage level of the first electrode Y from the positive sustain voltage Vs to the negative sustain voltage −Vs during the period t3; maintaining a voltage level of the first electrode Y at the negative sustain voltage −Vs during the period t4; raising a voltage level of the first electrode Y from the negative sustain voltage −Vs to the positive sustain voltage Vs during the period t5; supplying the data voltage Va to the third electrode X during the period t1; supplying the reference voltage to the third electrode X during the period t2; and causing the third electrode X to be floated during the periods t3, t4 and t5.

Since the first and second reference voltage sources 140 and 150 are electrically connected to each other during the period t2, the reference voltage supplied to the third electrode X during the period t2 means one of the first and second reference voltages.

In FIG. 9, the signals supplied to the first electrode Y and the third electrode X are measured based on the first reference voltage source 140.

The floating voltage of the third electrode X may be substantially equal to a sum (Va−Vs) of the data voltage Va and the negative sustain voltage −Vs.

A circuit operation during the period t1 of FIG. 9 is the same as the circuit operation of FIG. 8A, and a circuit operation during the period t2 of FIG. 9 is the same as the circuit operation of FIG. 8B.

Further, a circuit operation during the periods t3 and t4 of FIG. 9 is the same as the circuit operation of FIG. 6B. Only, a voltage level of the third electrode X falls from the first reference voltage to the voltage (Va−Vs) during the period t3. The reason why while a voltage level of the third electrode X is maintained at the second reference voltage during the period t2, a voltage level of the third electrode X falls from the first reference voltage during the period t3 is that the first reference voltage is substantially equal to the second reference voltage because the first reference voltage source 140 and the second reference voltage source 150 are connected to each other due to the turn-on operation of the reference separations switches M1 and M2.

A circuit operation during the period t5 of FIG. 9 is the same as the circuit operation of FIG. 6C. Only, a voltage level of the third electrode X rises from the voltage Va−Vs to the first reference voltage.

Since a circuit operation during the period t6 of FIG. 9 is the same as the circuit operation during the period t1 of FIG. 9, a voltage level of the third electrode X is maintained at the data voltage Va.

Since the plasma display apparatus according to an exemplary embodiment includes the reference separation controller between the reference voltage source connected to the sustain driver and the reference voltage source connected to the data driver, various driving methods can be provided and the third electrode can be floated during the sustain period.

The intensity of the opposite discharge during the sustain period can be reduced due to the floating of the third electrode, and thus the driving efficiency can be improved. Further, a damage to the phosphor caused by the opposite discharge can be prevented and life span of the plasma display panel can increase.

Embodiments of the invention being thus described, it will be obvious that the same may be varied in many ways. Such variations are not to be regarded as a departure from the scope of the invention, and all such modifications as would be obvious to one skilled in the art are intended to be included within the scope of the following claims.

What is claimed is:

1. A plasma display apparatus comprising:

a plasma display panel including a first electrode, a second electrode, and a third electrode positioned in an intersection direction of the first electrode and the second electrode;

a sustain driver that supplies a sustain signal including a positive sustain voltage and a negative sustain voltage to the first electrode during a sustain period;

a data driver that supplies a data signal to the third electrode during an address period;

a first reference voltage source that is commonly connected to the sustain driver and the second electrode;

a second reference voltage source connected to the data driver; and a reference separation controller that separates or connects the first reference voltage source from or to the second reference voltage source.

2. The plasma display apparatus of claim 1, wherein the reference separation controller is turned on during a positive sustain voltage maintenance period when a voltage level of the first electrode is maintained at the positive sustain voltage, so that the first reference voltage source is connected to the second reference voltage source, and the reference separation controller is turned off during the remaining period of time except the positive sustain voltage maintenance period from the sustain period, so that the first reference voltage source is separated from the second reference voltage source.

3. The plasma display apparatus of claim 2, wherein the data driver includes a top switch that controls the supply of a data voltage output from a data constant voltage source to the third electrode, and a bottom switch that controls the supply of a second reference voltage output from the second reference voltage source to the third electrode.

4. The plasma display apparatus of claim 3, wherein the top switch and the bottom switch are turned off during a period of time when the sustain driver supplies the sustain signal to the first electrode so that the data driver is in a hi-impedance state.

5. The plasma display apparatus of claim 4, wherein the third electrode is clamped during the positive sustain voltage maintenance period, so that a voltage level of the third electrode is maintained at the data voltage, and the third electrode is floated during the remaining period of time except the positive sustain voltage maintenance period from the sustain period.

6. The plasma display apparatus of claim 5, wherein a floating voltage of the third electrode is substantially equal to a sum of the data voltage and the negative sustain voltage during a period of time when the negative sustain voltage is supplied to the first electrode.

7. The plasma display apparatus of claim 3, wherein the top switch is controlled to supply the data voltage to the third electrode during a first period of the positive sustain voltage maintenance period, the first period being shorter than the positive sustain voltage maintenance period, the bottom switch is controlled to supply the second reference voltage to the third electrode during a second period of the positive sustain voltage maintenance period which follows the first period, and the third electrode is floated during the remaining period of time except the positive sustain voltage maintenance period from the sustain period.

8. A plasma display apparatus comprising:

a plasma display panel including a first electrode, a second electrode, and a third electrode positioned in an intersection direction of the first electrode and the second electrode;

a sustain driver whose one terminal is connected to the first electrode, and the other terminal is commonly connected to the second electrode and a first reference voltage source;

a reference separation switch whose one terminal is commonly connected to the other terminal of the sustain driver, the first reference voltage source, and the second electrode, and the other terminal is connected to a second reference voltage source;

a top switch whose one terminal is connected to the third electrode, and the other terminal is connected to a data constant voltage source; and a bottom switch whose one terminal is commonly connected to the third electrode and one terminal of the top switch, and the other terminal is commonly connected to the second reference voltage source and the other terminal of the reference separation switch.

9. A method of driving a plasma display apparatus comprising a plasma display panel including a first electrode, a second electrode, and a third electrode positioned in an intersection direction of the first electrode and the second electrode, a sustain driver that supplies a sustain signal including a positive sustain voltage and a negative sustain voltage to the first electrode during a sustain period, a data driver that supplies a data signal to the third electrode during an address period, a first reference voltage source that is commonly connected to the sustain driver and the second electrode, a second reference voltage source connected to the data driver, and a reference separation controller that separates or connects the first reference voltage source from or to the second reference voltage source, the method comprising:

supplying the sustain signal to the first electrode by the sustain driver;

turning on the reference separation controller during a positive sustain voltage maintenance period when a voltage level of the first electrode is maintained at the positive sustain voltage, so that the first reference voltage source is connected to the second reference voltage source; and turning off the reference separation controller during the remaining period of time except the positive sustain voltage maintenance period from the sustain period, so that the first reference voltage source is separated from the second reference voltage source.

10. The method of claim 9, further comprising turning off the data driver during a period of time when the sustain driver supplies the sustain signal to the first electrode so that the data driver is in a hi-impedance state.

11. The method of claim 10, wherein the third electrode is clamped during the positive sustain voltage maintenance period, so that a voltage level of the third electrode is maintained at the data voltage, and the third electrode is floated during the remaining period of time except the positive sustain voltage maintenance period from the sustain period.

12. The method of claim 11, wherein a floating voltage of the third electrode is substantially equal to a sum of the data voltage and the negative sustain voltage during a period of time when the negative sustain voltage is supplied to the first electrode.

13. The method of claim 9, further comprising supplying the data voltage to the third electrode by the data driver during a first period of the positive sustain voltage maintenance period, the first period being shorter than the positive sustain voltage maintenance period;

supplying a second reference voltage output from the second reference voltage source to the third electrode by the data driver during a second period of the positive sustain voltage maintenance period which follows the first period; and floating the third electrode during the remaining period of time except the positive sustain voltage maintenance period from the sustain period.

14. A method of driving a plasma display apparatus comprising a plasma display panel including a first electrode, a second electrode, and a third electrode positioned in an intersection direction of the first electrode and the second electrode, a sustain driver that supplies a sustain signal including a positive sustain voltage and a negative sustain voltage to the first electrode during a sustain period, a data driver that supplies a data signal to the third electrode during an address period, a first reference voltage source that is commonly connected to the sustain driver and the second electrode, a second reference voltage source connected to the data driver, and a reference separation controller that separates or connects the first reference voltage source from or to the second reference voltage source, the method comprising:

supplying a positive sustain voltage and a negative sustain voltage of a sustain signal to the first electrode during a sustain period;

supplying a data voltage to the third electrode during a first period of a positive sustain voltage maintenance period when a voltage level of the first electrode is maintained at the positive sustain voltage, the first period being shorter than the positive sustain voltage maintenance period;

supplying a voltage output from a reference voltage source to the third electrode during the remaining period of time except the first period from the sustain period; and turning on the reference separation controller during the positive sustain voltage maintenance period so that a first reference voltage source is connected to a second reference voltage source, and turning off the reference separation controller during the remaining period of time except the positive sustain voltage maintenance period from the sustain period, so that the first reference voltage source is separated from the second reference voltage source.

* * * * *